US011359495B2

(12) United States Patent
Loebig et al.

(10) Patent No.: US 11,359,495 B2
(45) Date of Patent: Jun. 14, 2022

(54) COVERAGE COOLING HOLES

(71) Applicants: Rolls-Royce Corporation, Indianapolis, IN (US); Rolls-Royce North American Technologies Inc., Indianapolis, IN (US)

(72) Inventors: James Loebig, Greenwood, IN (US); James Christopher Muskat, Mooresville, IN (US); Christopher Dwayne DeBruhl, Zionsville, IN (US)

(73) Assignees: Rolls- Royce Corporation, Indianapolis, IN (US); Rolls-Royce North American Technologies Inc., Indianapolis, IN (US)

( * ) Notice: Subject to any disclaimer, the term of this patent is extended or adjusted under 35 U.S.C. 154(b) by 401 days.

(21) Appl. No.: 16/241,195

(22) Filed: Jan. 7, 2019

(65) Prior Publication Data

US 2020/0217207 A1 Jul. 9, 2020

(51) Int. Cl.

| | |
|---|---|
| ***F01D 5/18*** | (2006.01) |
| ***F01D 9/06*** | (2006.01) |
| ***F01D 25/12*** | (2006.01) |

(52) U.S. Cl.

CPC ..... *F01D 5/186* (2013.01); *F01D 9/065* (2013.01); *F01D 25/12* (2013.01); *F05D 2220/32* (2013.01); *F05D 2240/128* (2013.01); *F05D 2260/202* (2013.01)

(58) Field of Classification Search

CPC ..... F01D 5/182–188

See application file for complete search history.

(56) References Cited

U.S. PATENT DOCUMENTS 5,062,768 A * 11/1991 Marriage ..... F01D 5/186 416/97 R
2006/0099074 A1* 5/2006 Kopmels ..... F01D 5/186 416/97 R

FOREIGN PATENT DOCUMENTS

| | | | | |
|---|---|---|---|---|
| EP | 1788193 A2 | 5/2007 | | |
| EP | 3179039 A1 * | 6/2017 | ..... | F01D 9/02 |
| EP | 3196423 A1 | 7/2017 | | |
| JP | 2011196360 A | 10/2011 | | |
| JP | 4954309 B2 | 6/2012 | | |
| WO | 2014/189092 A1 | 11/2014 | | |

OTHER PUBLICATIONS

Kusterer, K. et al., "The Nekomimi Cooling Technology Cooling Holes with Ears for High-Efficient Film Cooling," ASME 2011 Turbo Expo: Turbine Technical Conference and Exposition, vol. 5, Vancouver, BC, Canada, Jun. 6-10, 2011, pp. 303-313.

Papell, S.S., "Vortex Generating Flow Passage Design for Increased Film-Cooling Effectiveness and Surface Coverage," NASA Technical Memorandum 83617, 22nd National Heat Transfer Conference, Niagara Falls, New York, Aug. 5-8, 1984, 22pgs.

* cited by examiner

*Primary Examiner* — Adam Krupicka
(74) *Attorney, Agent, or Firm* — Crowell & Moring LLP

(57) ABSTRACT

A member may have a primary major surface and a secondary major surface. The member may form an array of apertures extending from the primary major surface to the secondary major surface. The array of apertures includes at least one aperture comprising two or more conduits. The axis of each conduit intersects the axis of each other conduit in the aperture. The cross-section of at least one of the conduits perpendicular to its axis may be circular. In some embodiments, an aperture may comprise two or three conduits.

20 Claims, 15 Drawing Sheets

COVERAGE COOLING HOLES

BACKGROUND

Turbine engines are a form of combustion engine. Like most combustion engines, the high temperatures created within a turbine engine can have adverse effects on the material properties of the structure forming the engine. Examples of these structures include the combustor, turbine blades, and the engine exhaust region. To combat these high temperatures, various cooling methods are employed. The efficiency and effectiveness of methods and systems used to cool components subject to a hot working fluid need improvement.

SUMMARY

According to some aspects of the present disclosure, a member is provided. The member may have a primary major surface and a secondary major surface. The member may form an array of apertures extending from the primary major surface to the secondary major surface. The array of apertures includes at least one aperture comprising two or more conduits. The axis of each conduit intersects the axis of each other conduit in the aperture. The cross-section of at least one of the conduits perpendicular to its axis may be circular. In some embodiments, an aperture may comprise two or three conduits. In some embodiments, the aperture has a total cross sectional area that may vary in magnitude from the primary major surface to the secondary major surface. The total cross sectional area may be at a minimum at a depth at which the axis of each conduits intersects the axis of each other conduit(s).

According to some aspects of the present disclosure, a solid sheet is provided. The sheet may define an array of apertures extending between the major surfaces. At least one of the apertures may comprise a plurality of conduits. Each of the conduits may have an axis forming an acute angle relative to one of the major surfaces. Each of the conduits may intersect the other conduits of the plurality of conduits such that the axis of each conduit is at an angle between 90 degrees and 10 degrees relative to the axes of the other conduits.

According to some aspects of the present disclosure, a method of forming an array of apertures in a member is provided. The member may have opposing major surfaces. The method may comprise forming a first conduit and forming a second conduit. Each of the first and second conduits may be formed in the member and may extend from one major surface to the other major surface. The axis of the first conduit may intersect the axis of the second conduit.

BRIEF DESCRIPTION OF THE DRAWINGS

The following will be apparent from elements of the figures, which are provided for illustrative purposes.

Figure 1A:
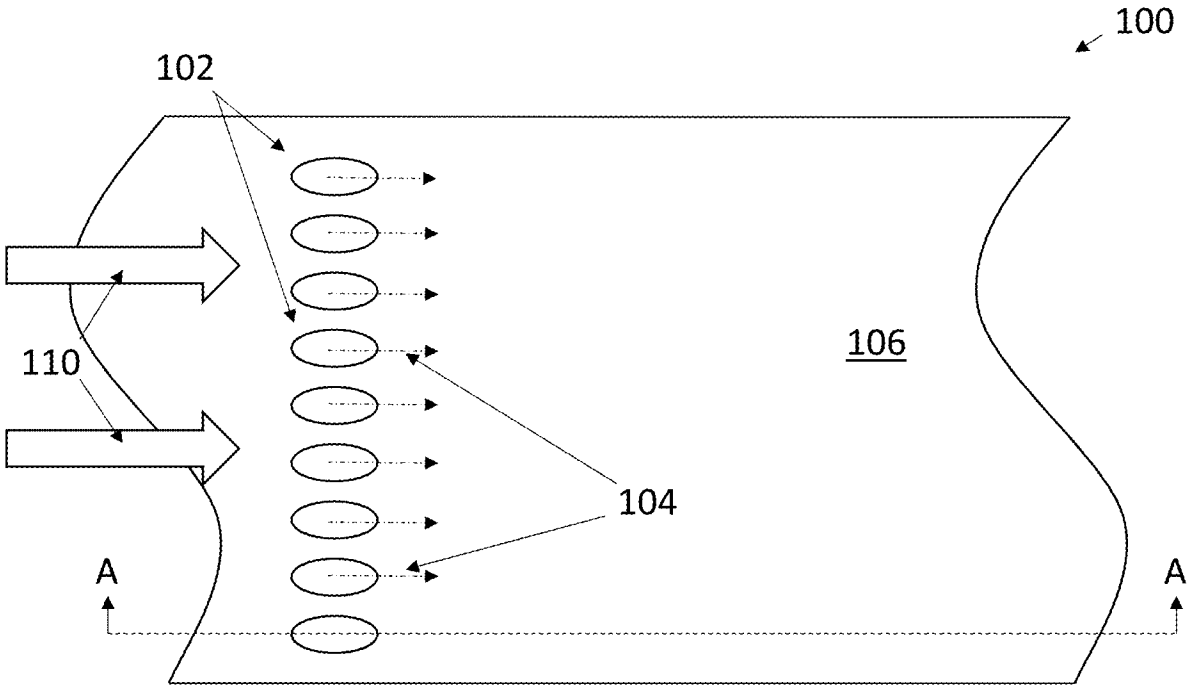
FIG. 1A illustrates a plan view of an array of cooling holes.

The present application discloses illustrative (i.e., example) embodiments. The claimed inventions are not limited to the illustrative embodiments. Therefore, many implementations of the claims will be different than the illustrative embodiments. Various modifications can be made to the claimed inventions without departing from the spirit and scope of the disclosure. The claims are intended to cover implementations with such modifications.

DETAILED DESCRIPTION

For the purposes of promoting an understanding of the principles of the disclosure, reference will now be made to a number of illustrative embodiments in the drawings and specific language will be used to describe the same.

Figure 1B:
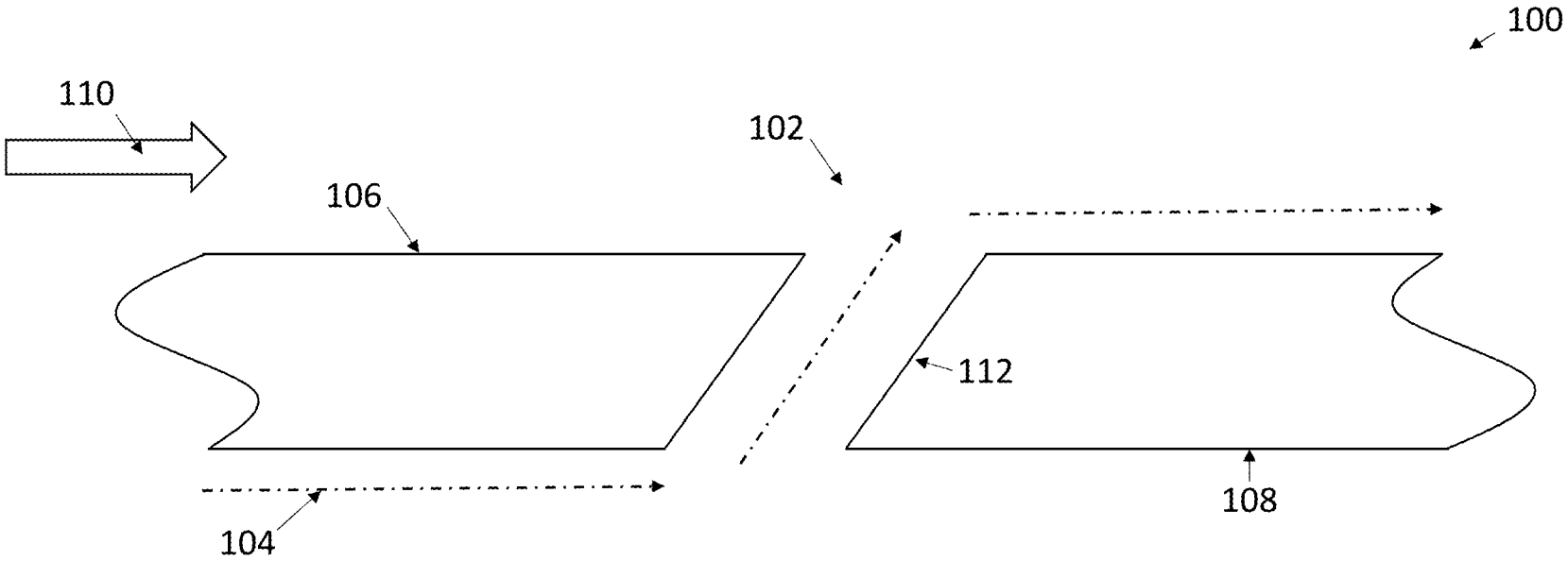
FIG. 1B illustrates a cross section of the array of a cooling hole of FIG. 1A taken at A-A.

FIG. 1A and FIG. 1B are illustrations of a member 100 having a plurality of apertures 102 that provide a cooling fluid 104. FIG. 1A is a plan view of member 100, and FIG. 1B is a cross-sectional view of member 100 taken through A-A. Member 100 has a pair of major surfaces—primary major surface 106 and secondary major surface 108. As used herein, "primary" refers to the hot or working fluid and "secondary" refers to the cooler or non-working fluid. Therefore, primary major surface 106 is the surface exposed to the hot, working fluid 110, and secondary major surface 108 is exposed to the cooling fluid 104. Member 100 may be made from metal, ceramics, composites, or other suitable material. Member 100 may be located in or downstream of a combustor, near or on the turbine airfoils and flow path components, in the turbine exhaust, a compressor, or other component requiring cooling.

Primary major surface 106 and secondary major surface 108 may be parallel to and/or opposed one another, or may not be parallel to one another. In some embodiments, the two surfaces 106 and 108 may form a curved member 100 such that a distance between the surfaces 106 and 108, measured in a direction normal from one of the surfaces to the other surface is constant. In other embodiments, the distance between the major surfaces may not be constant.

Member 100 forms an array of apertures 102 that extend between primary major surface 106 and secondary major surface 108. Each of the apertures 102 may be a cylindrical hole drilled through member 100. The drilled hole may be referred to as a conduit 112 herein. Elliptical openings are formed on primary major surface 106 and secondary major surface 108 when the conduit 112 of each aperture 102 is drilled because the axis of conduit 112 is at a non-zero angle relative to normal of primary major surface 106 and secondary major surface 108. If conduit 112 were drilled normal to primary major surface 106 and secondary major surface 108, a circular opening would be formed in both surfaces 106 and 108. Member 100 may be a solid member, meaning that it is formed of a continuous material between both surfaces 106 and 108 with the exception of apertures 102.

A cooling fluid 104 is supplied to member 100 on its secondary major surface 108 side at a sufficient pressure to drive the cooling fluid 104 through conduits 112 of apertures 102. Ideally, the cooling fluid 104 forms a film on primary major surface 106. This film provides both a barrier between the hot working fluid 110 and primary major surface 106 and a heat sink for member 100. This is known as film, or effusion, cooling. However, the array of apertures 102, each formed of a single, cylindrical conduit 112, can lead to counter-rotating vortices within the cooling fluid 104 when the cooling film interacts with the large, primary fluid flow. In turn, these vortices can lift a significant portion of the cooling fluid 104 away from the primary major surface 106, causing a loss of the heat sink and thermal barrier. As a result of this loss of the effusion cooling, the primary major surface 106 will reach higher temperature, potentially shortening component lifespan of or requiring member 100 to be comprised of different materials.

One solution to address this problem is to provide more cooling fluid 104 the apertures 102 to account for the removal of cooling fluid 104 film. Supplying more cooling fluid 104 reduces system efficiency as, for example, more bleed air is removed from the compressor and, therefore, also form the working fluid.

Another solution to addressing the loss of the cooling film layer has been to use differently shaped apertures. For example, shaped holes have been explored as a potential solution to the undesirable loss of the cooling film by creating vortices that tend to cancel those created by the cooling film—primary fluid interaction. Shaped apertures utilize a single, conduit extending through the member 100, but have a complex exit region intended to affect the flow characteristics of cooling fluid 104. However, the complex exit region may require micromachining which is expensive compared to other drilling technologies, e.g., water jets, lasers, and electrical discharge machining (EDM).

There exists a need for methods and systems having improved effusion cooling capabilities and higher system efficiencies that can be made at lower cost.

Figure 2A:
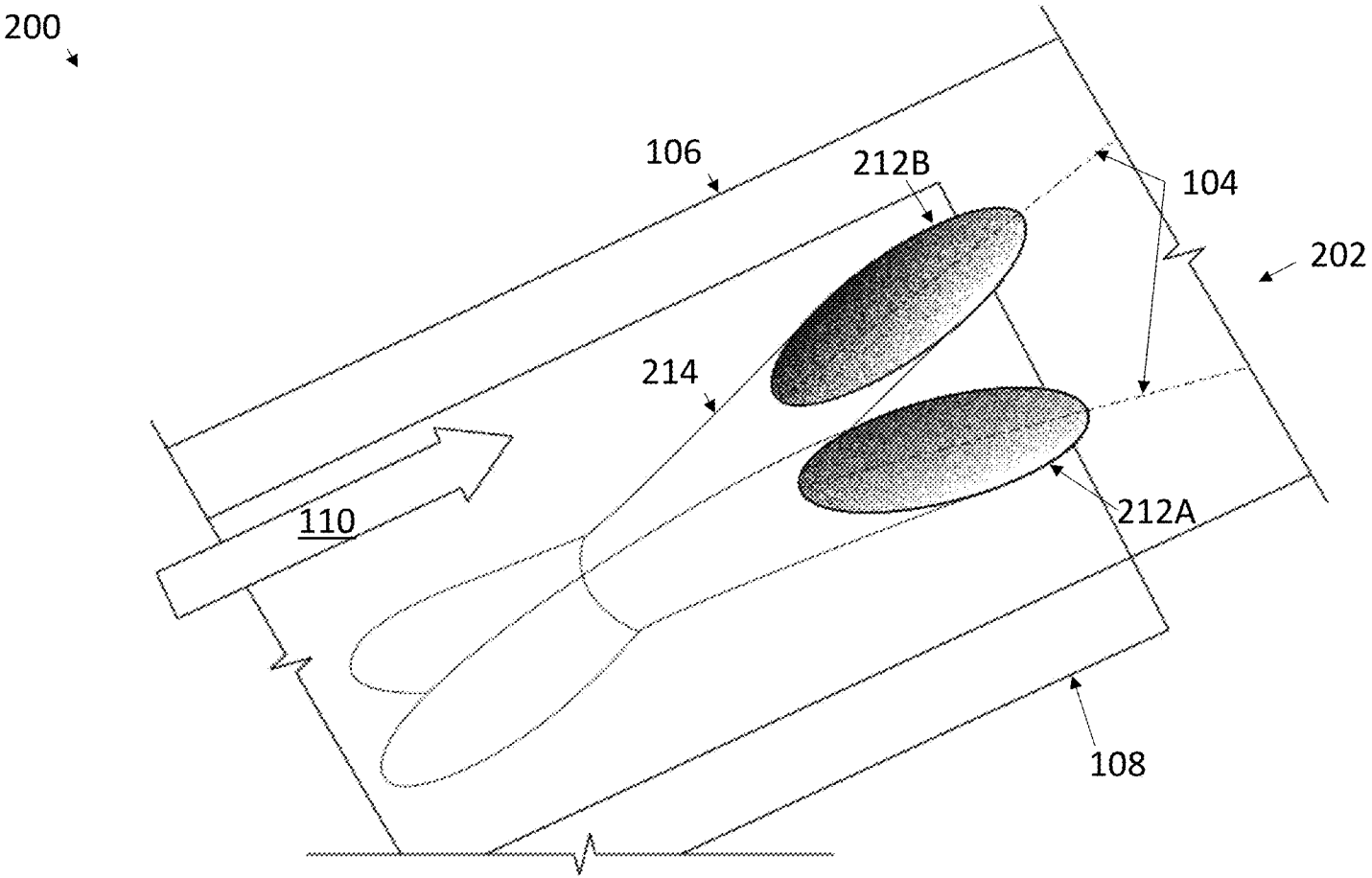
FIG. 2A illustrates a perspective view of a member in accordance with some embodiments.
Figures 2B, 2C:
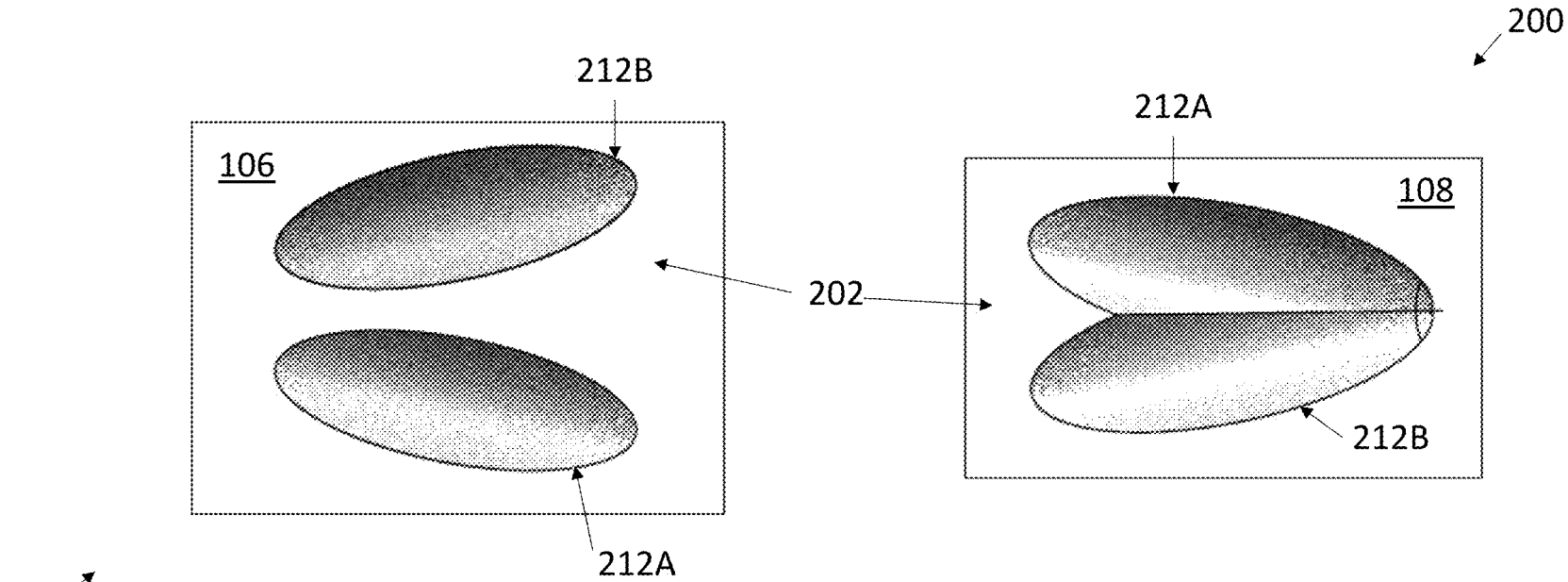
FIG. 2B illustrates a plan view of the member of FIG. 2A in accordance with some embodiments.
FIG. 2C illustrates a plan view of the member of FIG. 2A from a different perspective in accordance with some embodiments.

An example of system having improved effusion cooling that can be made at lower cost is provided in FIGS. 2A-2C. FIG. 2A illustrates a perspective view of a member 200 in accordance with some embodiments. FIG. 2B illustrates plan view of the member 200 in accordance with some embodiments. FIG. 2C illustrates plan view of member 200 from a different perspective than the plan view in FIG. 2B in accordance with some embodiments. Member 200 may comprise the same materials and perform similar functions as member 100 described above. Member 200 may comprise an array of apertures 202, a primary major surface 106, and a secondary major surface 108. FIGS. 2A to 2C show a single aperture 202 that extends from the primary major surface 106 to secondary major surface 108.

FIG. 2A illustrates the boundary 214 of aperture 202 as it extends between the primary major surface 106 to secondary major surface 108. Aperture 202 is different from aperture 102 in at least two ways. First, aperture 202 may be formed from multiple conduits such as the illustrated conduits 212A and 212B. Each of the conduits 212 of a single aperture 202 are drilled through member 200 such that each conduit 212 defines volume that occupies the same space as a portion of the volume occupied by another conduit 212 forming the same aperture 202. Each of the conduits may be drilled separately in member 200 using the above mentioned drilling techniques (laser, water jet, EDM). Aperture 202 may form a single, complex exit region in member 200 because the conduits 212 are drilled in this manner.

Figure 2D:
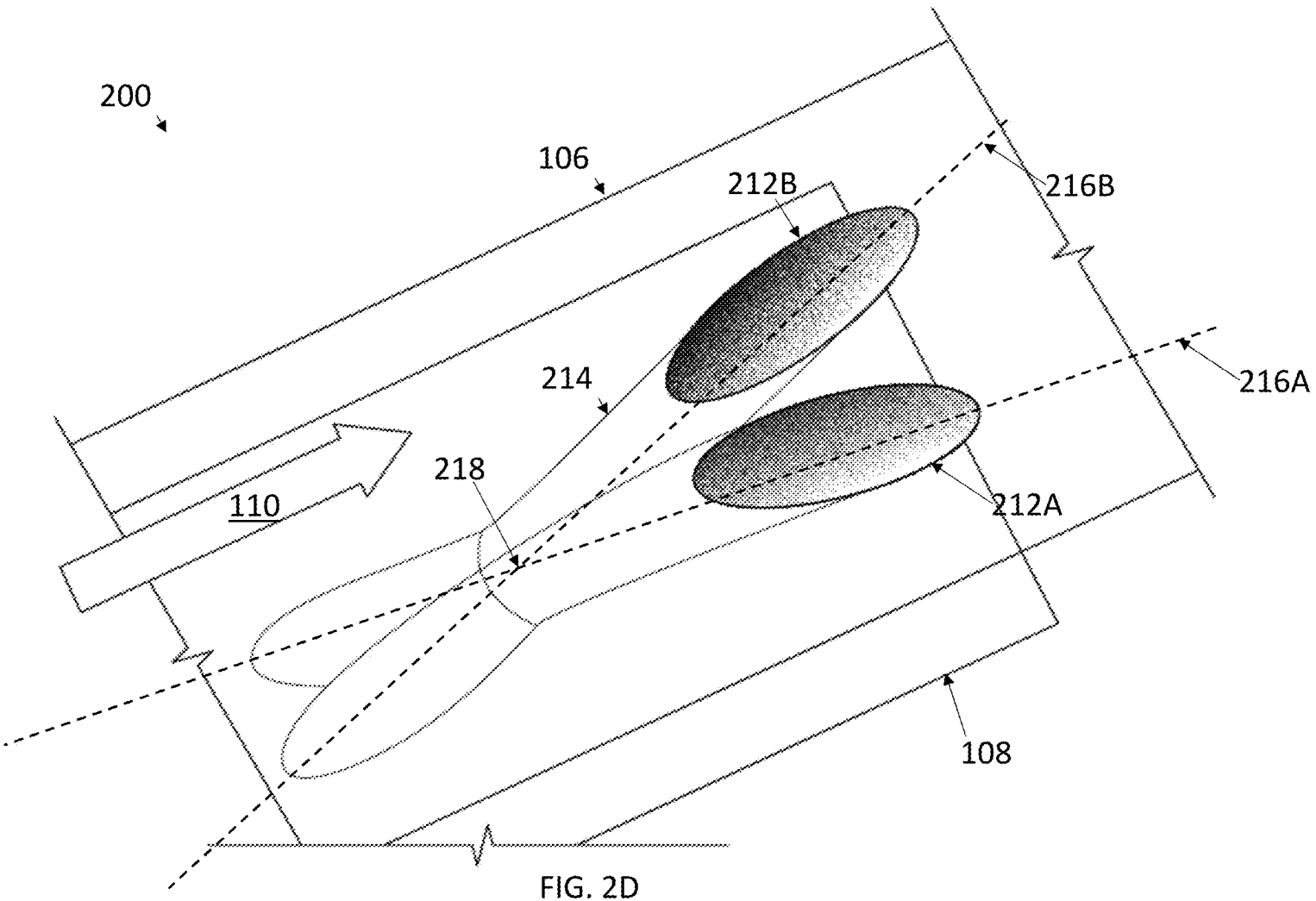
FIG. 2D illustrates a perspective view of the member of FIG. 2A in accordance with some embodiments.
Figure 2E:
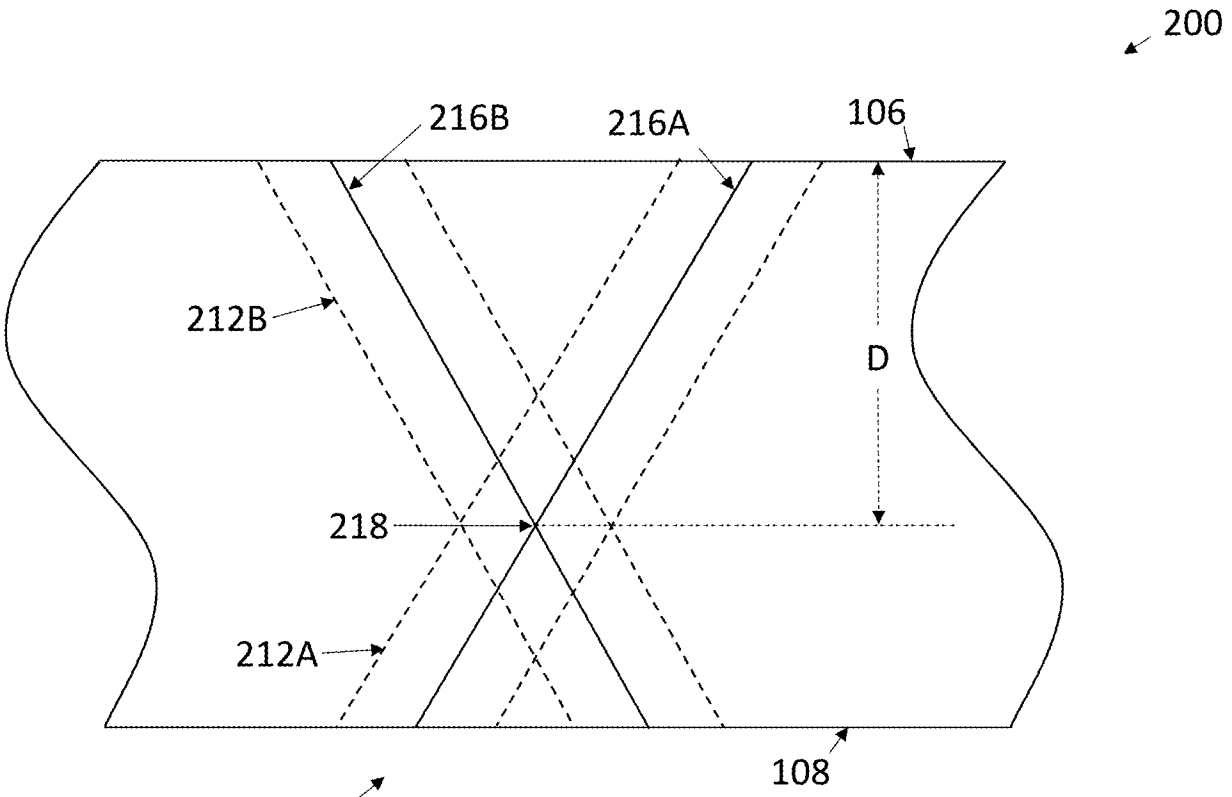
FIG. 2E illustrates cross-sectional view of the member of FIG. 2A in accordance with some embodiments.

Second, each conduit 212 may have a centerline axis 216 that may intersect the axis 216 of another conduit 212. For example, each conduit 212 has a centerline axis, such as axis 216A and 216B for conduits 212A and 212B, respectively as shown in both FIG. 2D—the same perspective view of member 200 as shown in FIG. 2A—and FIG. 2E—a cross-sectional view of member 200. Axis 216A intersects axis 216B at intersection point 218. This point 218 is located at a depth 'D' beneath the primary major surface 106. By intersecting the axes of the two or more conduits 212 forming aperture 202, there is a restriction in the total cross-sectional area of the aperture 202 where the axes 216 intersect. This restriction in the total cross-sectional area of aperture 202 acts as a restrictor for the cooling fluid 104.

Figure 3A:
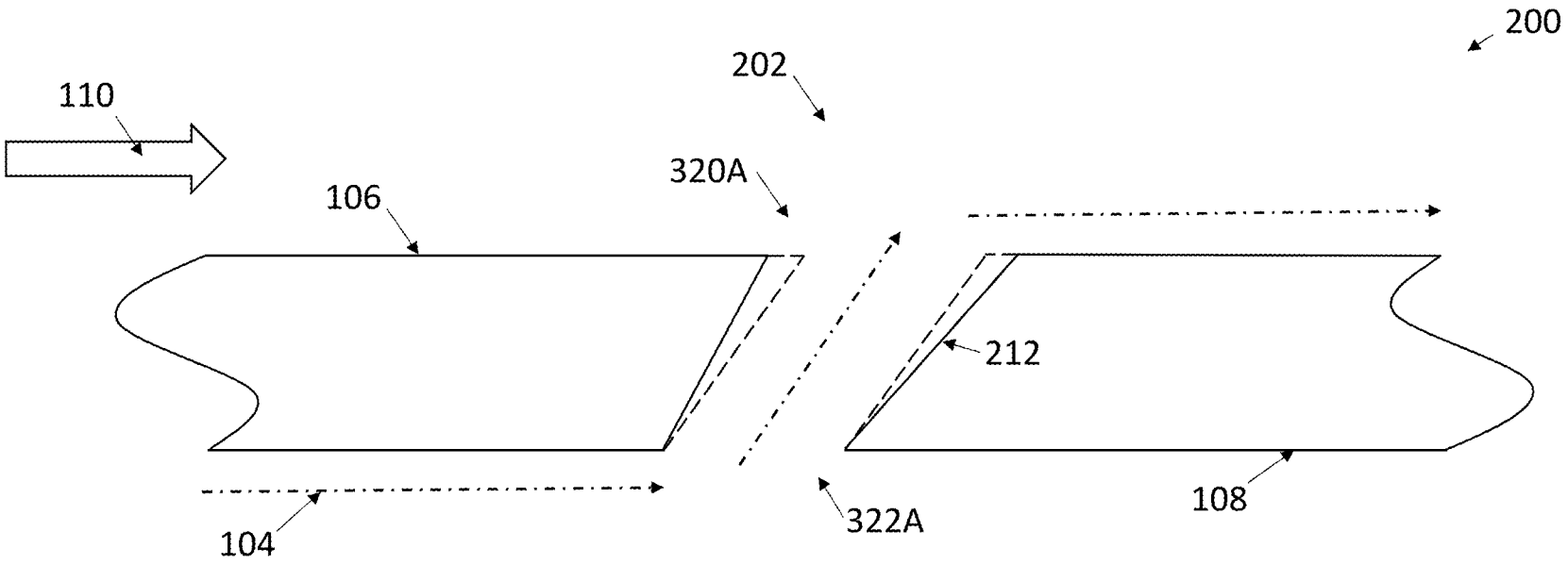
FIGS. 3A and 3B illustrate cross-sectional views of a conduit of the member of FIG. 2A in accordance with some embodiments.
Figure 3B:
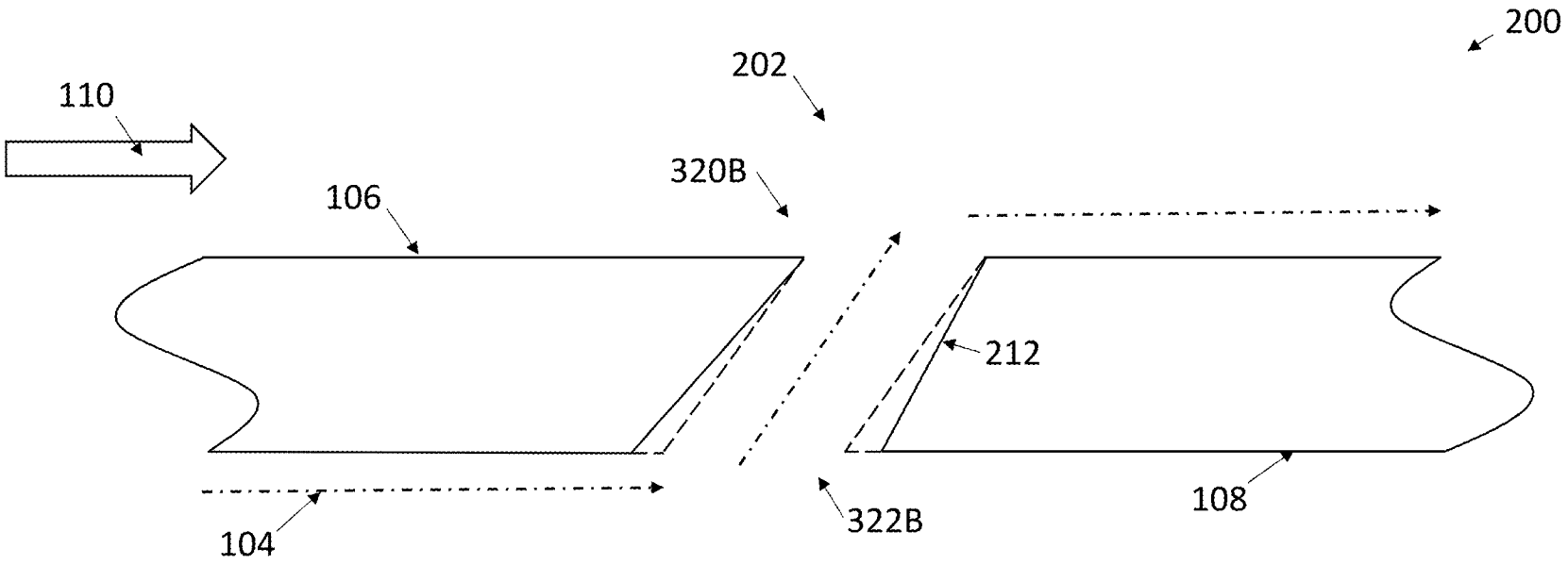

Each conduit 212 may have a circular cross section about its respective axis 216 when it is drilled in member 200. In some embodiments, this circular cross section is constant along the axial length of conduit 212. In such cases, the conduits 212 are cylindrical. In accordance with some embodiments, the conduits may be conical. In some embodiments, the cross section of the conduit(s) 212 is uniform in shape about it axis. These conduits may be drilled by, e.g., a laser that tends to produce a conical shape as more material is removed from the side on which the laser first engages the member. Examples of such embodiments are illustrated in FIGS. 3A and 3B—both cross sectional views of a conduit of member 200. With reference to FIG. 3A, an embodiment in which the conduit 212 is drilled from the primary major surface 106 is presented. As can be seen, conduit 212 has an opening 320A in the primary major surface 106 that is larger than the opening 322A in the secondary major surface 108. In this embodiment, the cross section of the conduit decreases in area from the primary major surface 106 to the secondary major surface 108. The dotted lines between the lateral sides of conduit 212 represent the outer diameter of the cylindrical conduit having a cross section area equal to the area of the opening 322A. As can be seen in FIG. 3A, the walls of conduit 212 diverge from this cylindrical hole. It should be understood that this divergence is large in FIG. 3A for ease of reference, and that the actual divergence between the conical conduit 212 and the cylindrical conduit may be different from that shown.

Turning to FIG. 3B, an example of a conduit 212 drilled from the secondary major surface 108 is presented. Conduit 212 may have an opening 322B in the secondary major surface 108 that is wider than its opening 320B in the primary major surface 106. Like FIG. 3A, the dotted lines in FIG. 3B represent the outer diameter of cylindrical conduit. In this embodiment, the cross section of the conduit increases in area from the primary major surface 106 to the secondary major surface 108. The selection of a conical conduit 212 like that in FIG. 3A or FIG. 3B is influenced by the overall system design of the turbine engine. The conical conduit 212 of FIG. 3A provides for better film cooling, while the conical conduit 212 of FIG. 3B may provide for fewer overall losses.

As described above with respect to FIGS. 2A to 2E, conduits 212 are each drilled such that the axis 216 of each conduit intersects the axes of the other conduits 212 of aperture 202 at an intersection point 218 that is located at a depth 'D' below the primary major surface 106. Each conduit 212 can be further defined by the angle of its axis relative to normal of the primary major surface 106 (also known as a streamwise angle), known herein as angle 'A,' as well as the angle of its axis relative to the overall direction of the primary fluid flow (also known as a spanwise angle), herein known as angle 'B.' A person having ordinary skill will recognize that the direction of the primary fluid flow is complex. As used herein, the primary fluid flow direction refers to the direction of the velocity vector of the near hot-wall flow.

Figure 4A:
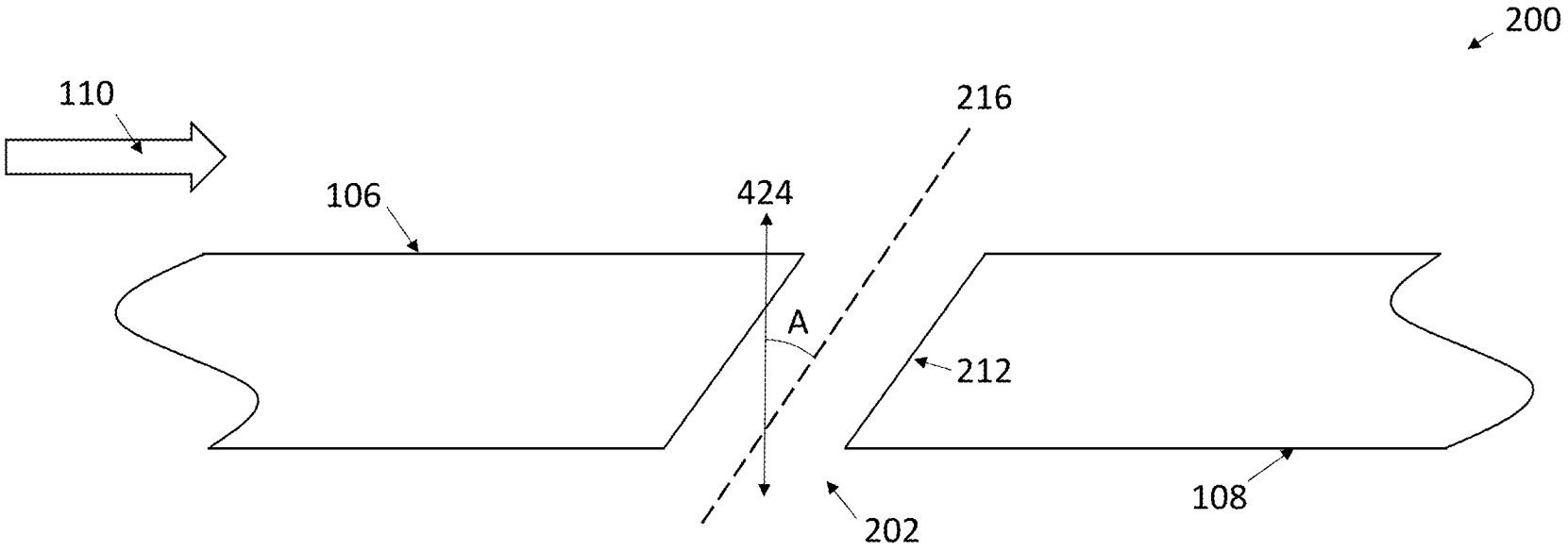
FIGS. 4A and 4B illustrate cross-sectional view and a plan view, respectively, of a conduit of the member of FIG. 2A in accordance with some embodiments.

FIG. 4A illustrates a cross sectional view of one of the conduits 212 of member 200 in accordance with some embodiments. This figure illustrates angle 'A' and the direction 424 that this normal to the primary major surface 106. It should be understood that FIG. 4A illustrates the cross section along the axis of one of conduits 212 forming aperture 202. In accordance with some embodiments, 'A' is between 75 and 10 degrees. In accordance with some embodiments, 'A' is between 75 and 45 degrees. In accordance with some embodiments, 'A' is between 65 and 55 degrees. In accordance with some embodiments, 'A' is between 45 and 10 degrees. In accordance with some embodiments, 'A' is between 30 and 10 degrees. In accordance with some embodiments 'A' is approximately 20 degrees. As can be appreciate, 'A' can be an acute angle.

Figure 4B:
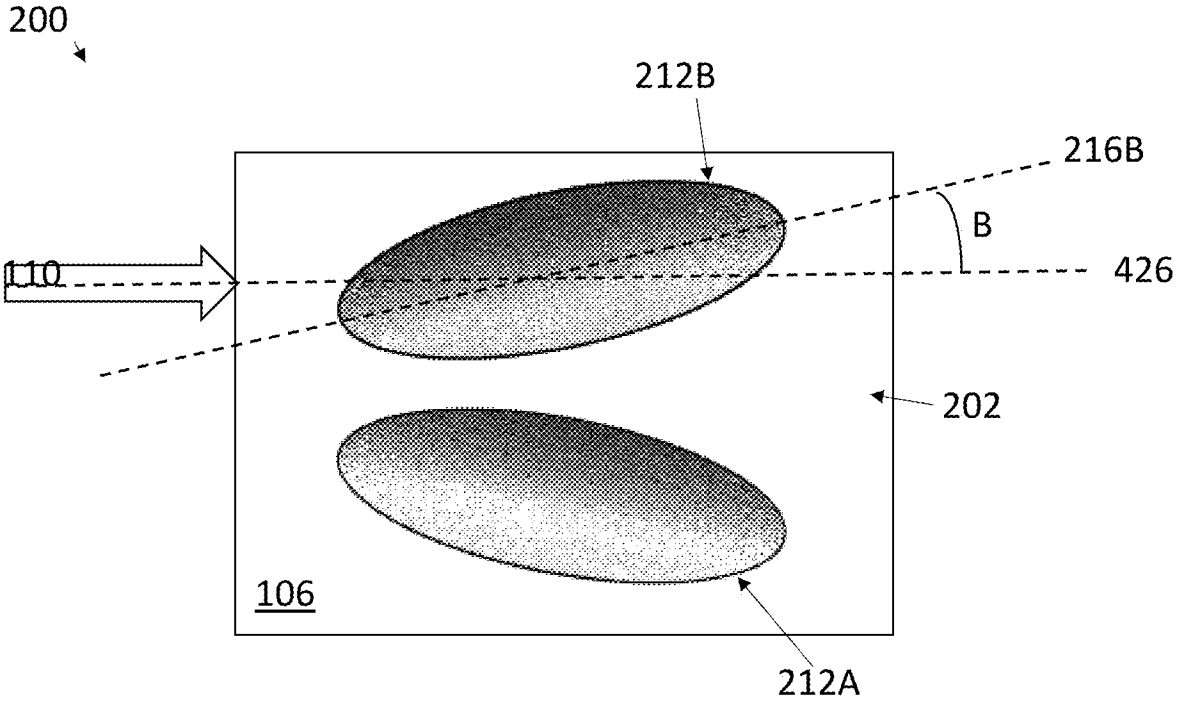

FIG. 4B illustrates a plan view of the member 200 in accordance with some embodiments. As can be seen, axis 216B of conduit 212B forms an angle 'B' with the direction of the primary fluid 426. In accordance with some embodiments, 'B' is between 45 and 5 degrees. In accordance with some embodiments, 'B' is between 30 and 5 degrees. In accordance with some embodiments 'B' is approximately 10 degrees. While not labeled in FIG. 4B, it should be understood that the axis 216A of conduit 212A also forms another angle relative to the direction 426. In accordance with some embodiments, this other angle is equal in magnitude but opposite in direction to 'B.' In accordance with embodiments of apertures having more than two conduits 212, at least two of the more than two conduits 212 may form an angle relative to the direction 426 that have equal magnitudes but opposite directions.

While the angle 'B' can be defined between an axis 216 of a conduit 212 and direction 426, it is also possible to describe the aperture 202 in terms of the angle measured between the axes of two conduits. In accordance with some embodiments, this angle is two times the angle 'B' described above.

Figure 5A:
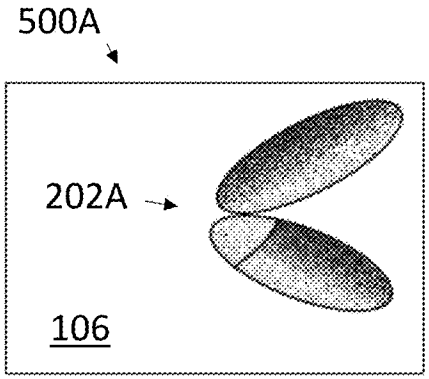
FIGS. 5A to 5C illustrate various perspective views of apertures in accordance with some embodiments.
Figure 5B:
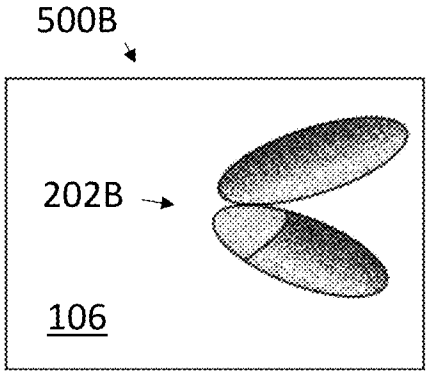
Figure 5C:
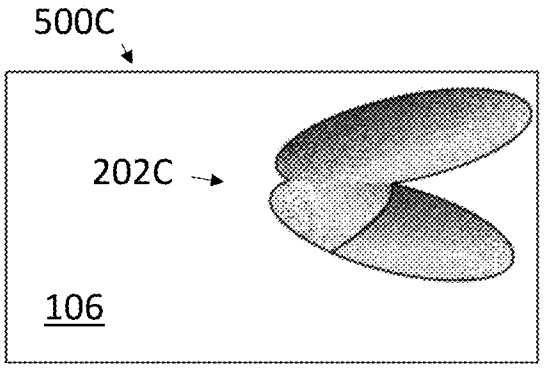

The number of conduits 212, the diameter and shape of the conduits 212, the angles of each conduit 'A' and 'B', and the location and depth of the intersection point 218 define the resultant aperture 202. FIGS. 5A to 5C illustrate various members 500A to 500C having apertures 202A to 202C in which the angle 'B' is varied. The largest angle 'B' is shown in FIG. 5A and the smallest angle is in 5C. In FIG. 5A, 'B' is sufficiently large such that the opening in the primary major surface 106 formed by each conduit 212 of the aperture 202A does not overlap with the opening of the other conduits. This creates an aperture 202A that forms a continuous volume within member 500A, but has a discrete opening for each of the conduits. Whether the secondary major surface 108 also has discrete openings for each conduit or a combined (overlapping) opening is dependent upon the depth 'D' at which the axes of the conduits intersect.

Turning to FIG. 5B, angle 'B' is reduced such that the opening of each conduit in primary major surface 106 touches the edge of the other opening. Angle 'B' is still further reduced in FIG. 5C, wherein it is sufficiently small such that there is significant overlap between the openings of each conduit 212 in the primary major surface 106.

In each of the above examples of aperture 202, the smallest cross sectional area of the aperture 202 occurs at the point of intersection 218 of the axes of the conduits 212.

Figure 6A:
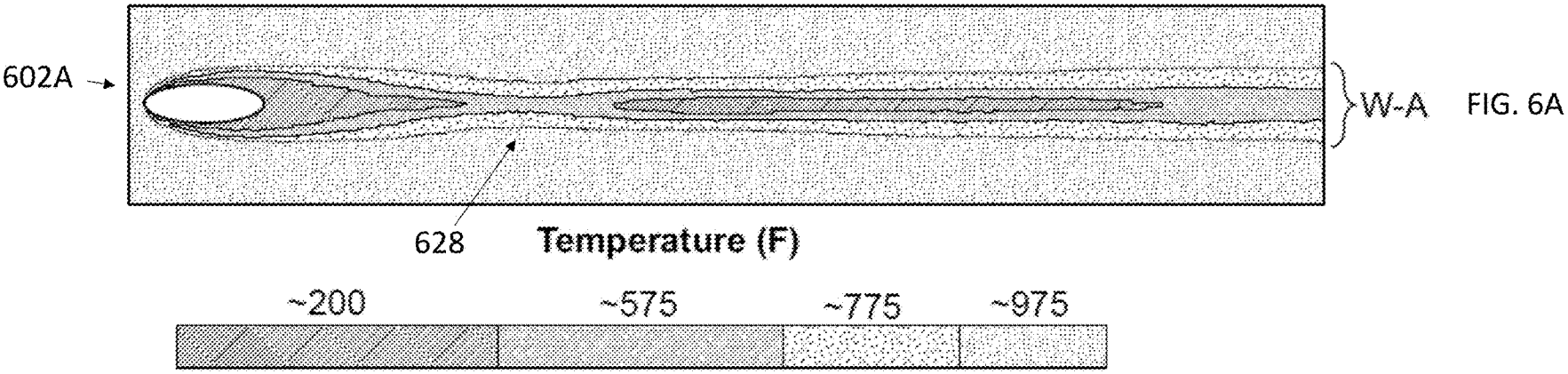
FIGS. 6A and 6B are computational fluid dynamic analyses of various apertures.
Figure 6B:
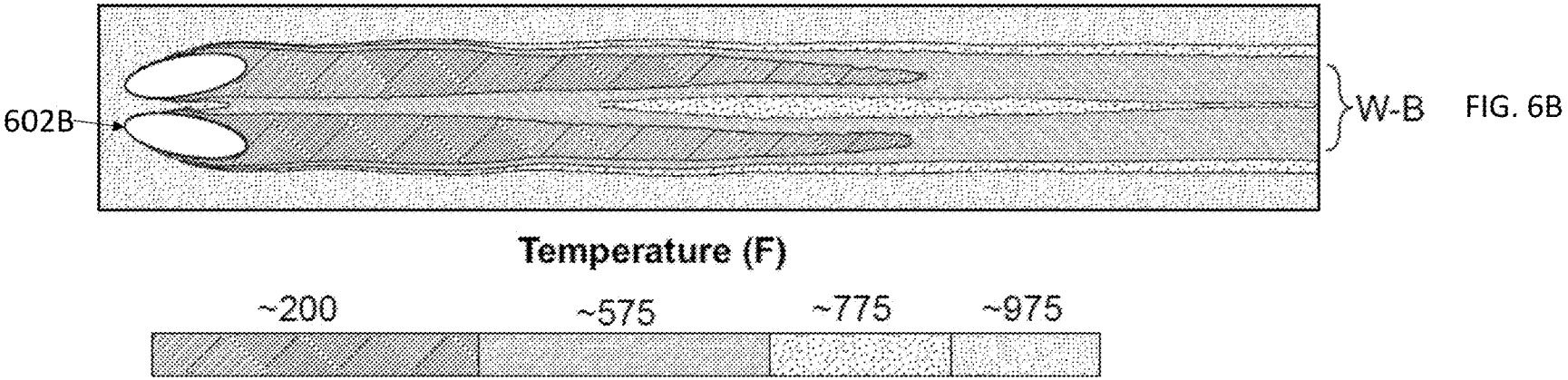

FIGS. 6A and 6B illustrates a computational flow dynamic analysis of the adiabatic wall temperature of a surface for a single and dual conduit aperture, respectively. Aperture 602A is formed of a single conduit that has an angle 'A' of 20 degrees. Aperture 602B is formed of two conduits, each of also has an angle 'A' of 20 degrees, however, with offsetting 'B' angles of approximately 10 degrees. Each wall is subjected to the same primary flow path conditions and each aperture is provided with the same total mass flow rate of cooling fluid. This model uses periodic boundary conditions of a single row of apertures having the same spacing between apertures.

As can be seen, aperture 602A creates a downstream constriction in the cooling film, leading to higher wall temperatures at point 628. Additionally, the cooling film from resulting from aperture 602A has a width 'W-A' that is about half that ('W-B') as provided by aperture 602B. Aperture 602B also does not resulting in the same constriction of cooling flow like that seen at point 628.

In accordance with some embodiments, more than two conduits may be utilized to form an aperture. Examples of such embodiments are provided in FIGS. 7A to 7C. With reference to FIG. 7A, a member 700A having an aperture 702A is provided. Aperture 702A is illustrated with three conduits—712A-A, 712A-B, and 712A-C. Each of these conduits 712A-A to 712A-C may be formed similar to and have similar characterizes as the conduits 212 described above. However, aperture 702A has third conduit 712A-C. While some embodiments have the same magnitude angle 'B' for conduits 712A-A and 712A-B, conduit 712A-C may have a different angle 'B' with the primary flow direction than conduits 712A-A and 712A-B. For example, 712A-C may be effectively aligned with the primary flow direction such that its axis 716A-C (not labeled) is parallel to the primary flow direction. In some embodiments, there may be slight deviations between the primary flow direction and the axis 716A-C. For example, the angle 'B' of 716A-C may be the same as angle 'B' as described above. In some embodiments, the angle 'B' of 716A-C between −10 and 10 degrees. In some embodiments, the angle 'B' of 716A-C between −5 and 5 degrees. In some embodiments, the angle 'B' of 716A-C between −2.5 and 2.5 degrees. In some embodiments, the angle 'B' of 716A-C may be zero degrees.

Figure 7C:
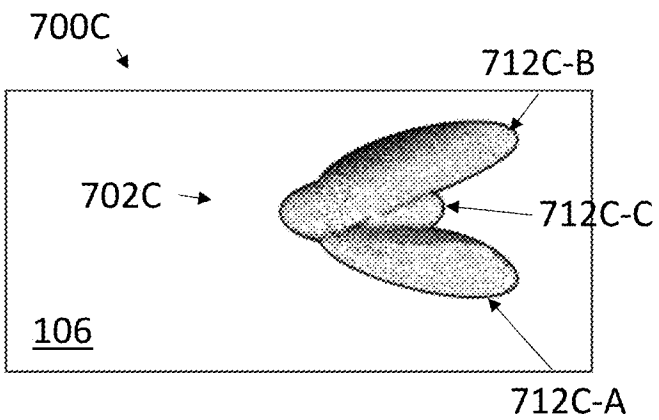
FIGS. 7A to 7C illustrate various perspective views of apertures having more than two conduits in accordance with some embodiments.
Figure 7B:
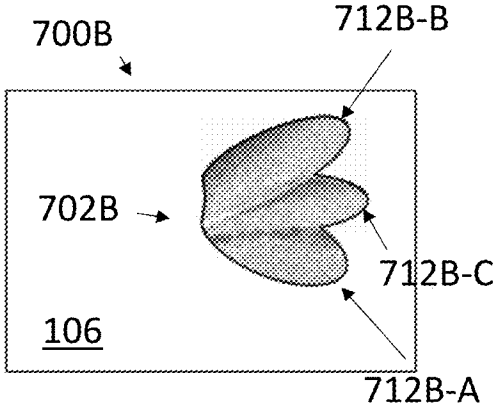
Figure 7A:
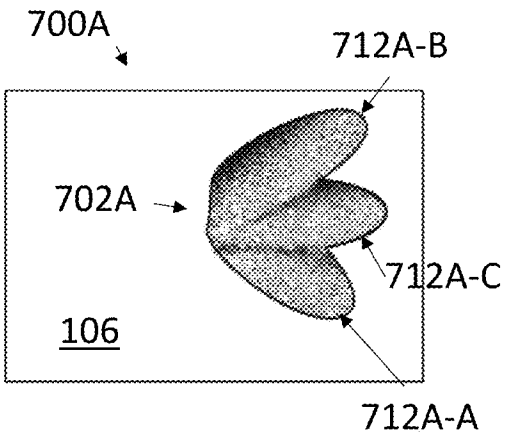

FIG. 7B and FIG. 7C illustrate members 700B and 700C, respectively, and are primarily the same as FIG. 7A. However, similar to the relationship between FIG. 5A and FIGS. 5B and 5C, FIGS. 7B and 7C utilize the three-conduit design of FIG. 7A with, however, a different angle 'B' for at least two of the conduits. The resulting apertures 702B and 702C are showing in FIGS. 7B and 7C, respectively.

Figure 8B:
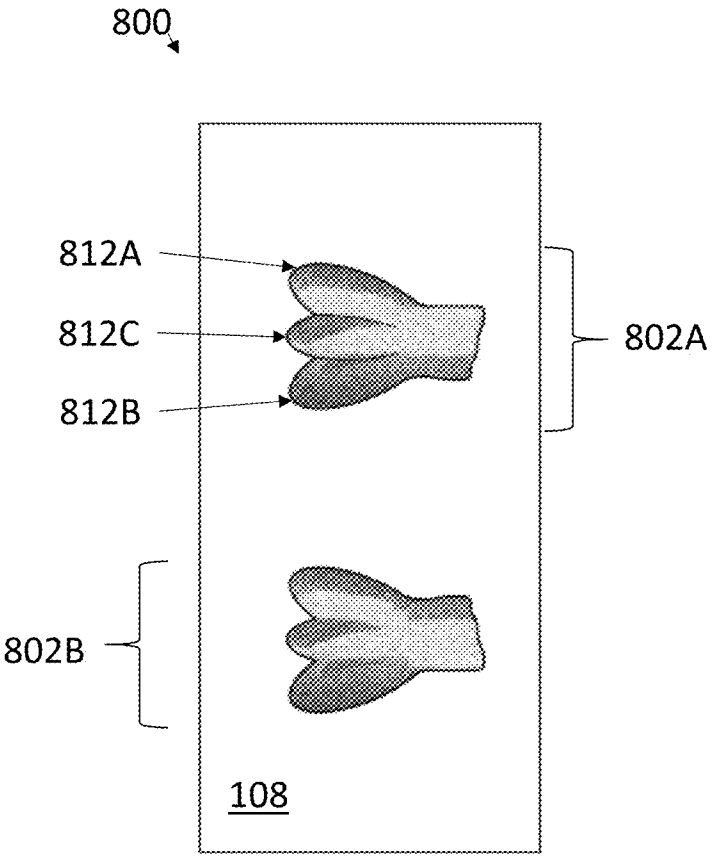
FIGS. 8A and 8B illustrate plan views from different perspectives of apertures in accordance with some embodiments.
Figure 8A:
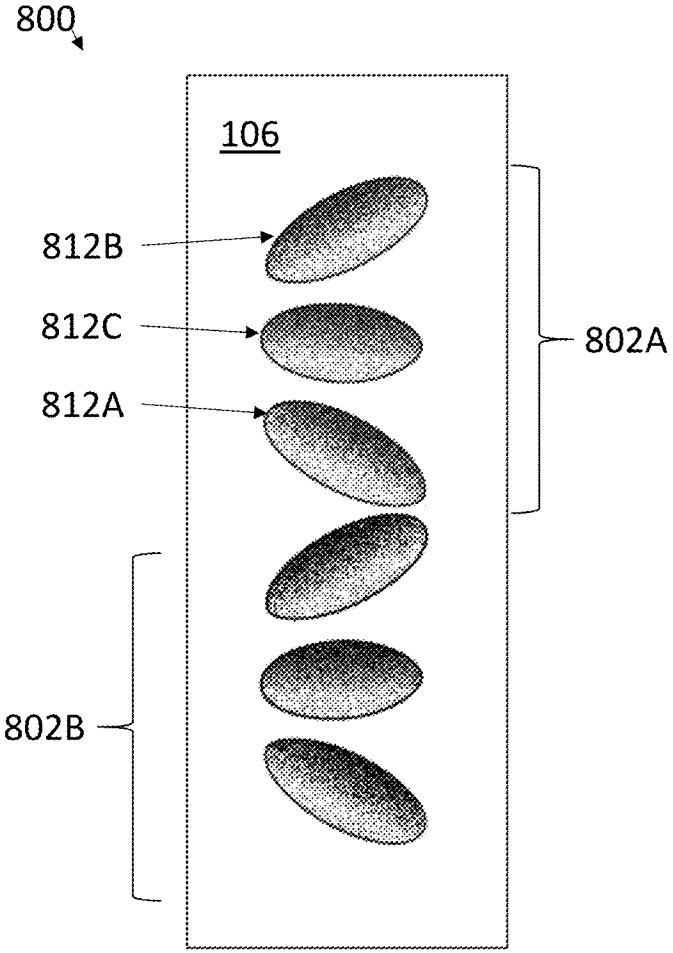

Plan views from different perspectives of a member 800 in accordance with some embodiments is provided in FIGS. 8A and 8B. Each figure illustrates two apertures 802A and 802B. Each aperture 802 is comprised of three conduits. For example, aperture 802A is formed from three conduits

812A, 812B, and 812C. Due to the spanwise angle 'B' and location of the point of intersection between the axes (not labeled) of 812A to 812C, each conduit forms a discrete opening in the primary major surface 106 and a common opening in the secondary major surface 108. As can be appreciated, these resulting openings can be changed by changing the angles 'A' and 'B' for each conduit along with the location of the intersection of the axes and the diameter of the conduits.

Figure 9:
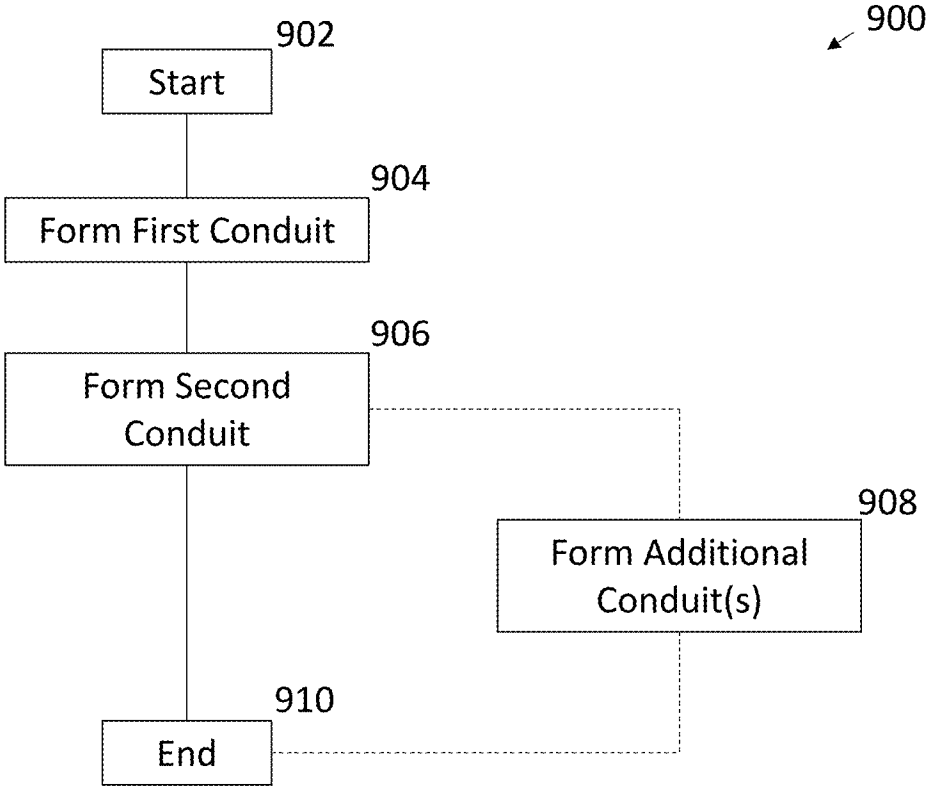
FIG. 9 is a block diagram of method of forming an aperture in accordance with some embodiments.

In accordance with some embodiments, method 900 of forming an aperture is provided for in FIG. 9. The aperture may have the same characteristics and properties of the apertures described above. The aperture may extend between the major surfaces of a member. The member may have the same characteristics and properties of the apertures described above. Method 900 starts at block 902. At block 904, a first conduit is formed. The conduit may extend from one of the major surfaces to the other. This conduit, and each other conduit formed in this method, may have the same characteristics and properties of the conduits described above. The method continues at block 906, where a second conduit is formed in the member extending from one major surface to the other major surface. During the formation of the second conduit, an axis of the second conduit may intersect the axis of the first conduit. Optionally, the method may continue at block 908 where additional conduits are formed in the member. Like some of the embodiments above, each of these additional conduits has an axis that intersects the axes of the other conduits at a common point. At block 910, the method ends. Each conduit may be formed using the particular techniques as described above.

While the above embodiments have been described as apertures in a singled-walled member (walled by the primary and secondary major surfaces), the principles disclosed herein are equally applicable to multi-walled cooling systems, such as Lamilloy®. For example, the apertures having the conduits as described above may be formed in one or both of the layers of a plurality of multi-stacked members.

Although examples are illustrated and described herein, embodiments are nevertheless not limited to the details shown, since various modifications and structural changes may be made therein by those of ordinary skill within the scope and range of equivalents of the claims.

What is claimed is:

1. A member having a primary major surface and a secondary major surface, said member forming an array of apertures extending from said primary major surface to said secondary major surface, said array of apertures including an aperture comprising a plurality of conduits, wherein each respective conduit of the conduits comprises an axis, wherein the axis of the respective conduit intersects the axis of each other conduit at an intersection point, wherein each respective conduit of the conduits further comprises a discrete conduit outlet at the primary major surface and a conduit inlet at the secondary major surface, the conduit inlet aligned with the axis of the respective conduit, wherein each conduit inlet of the conduits partially overlaps another conduit inlet of the conduits forming a common aperture inlet, wherein a shape of the common aperture inlet at the secondary major surface comprises a plurality of overlapping ellipses converging to a minimum width of the common aperture inlet, wherein the overlapping ellipses form a fan shape at a first end of the common aperture inlet, the common aperture inlet further extending along the secondary major surface from the minimum width towards a second end of the common aperture inlet.

2. The member of claim 1 wherein a cross-section of at least one of said conduits perpendicular to its axis is circular.

3. The member of claim 2 wherein the cross-section of each of said conduits, perpendicular to its axis, is circular.

4. The member of claim 3 wherein said aperture comprises two or three conduits.

5. The member of claim 3 wherein said cross-section of each conduit increases in area from said primary major surface to said secondary major surface, wherein the cross-section of each conduit increases in area from the primary major surface to the intersection point.

6. The member of claim 3 wherein said cross-section of each conduit decreases in area from said primary major surface to said secondary major surface, wherein the cross-section of each conduit decreases in area from the intersection point to the secondary major surface.

7. The member of claim 3 wherein the axis of each conduit is at an angle between 75 degrees and 45 degrees relative to the primary major surface in a first direction.

8. The member of claim 7 wherein the axis of each conduit is at an angle between 90 degrees and 10 degrees relative to the axes of the other conduits.

9. The member of claim 1 wherein a cross-section of each of said apertures perpendicular to its axis is uniform in shape.

10. The member of claim 1 wherein said primary and secondary major surfaces are substantially parallel.

11. The member of claim 1 wherein said aperture comprises a single discrete opening at said secondary major surface and a plurality of discrete openings at said primary major surface.

12. The member of claim 1, wherein the axis of each conduit is at an angle relative to a spanwise direction, wherein said angle has an absolute magnitude of between 45 degrees and 5 degrees.

13. The member of claim 1, wherein the axes of two or more conduits are at an first angle relative to a spanwise direction, wherein said first angle has an absolute magnitude of between 45 degrees and 5 degrees, and the axis of a third conduit is at an second angle relative to a spanwise direction, wherein said second angle has an absolute magnitude of between 0 degrees and 10 degrees.

14. The member of claim 1, wherein the aperture has a total cross sectional area that varies in magnitude from said primary major surface to said secondary major surface, and wherein said total cross sectional area is at a minimum at a depth at which the axis of each conduits intersects the axis of each other conduit.

15. A solid sheet having primary major surface and a secondary major surface, said sheet defining an array of apertures extending between the primary major surface and the secondary major surface, at least one of said apertures comprising a plurality of conduits, each respective conduit of said conduits having an axis, the axis forming an acute angle relative to the primary major surface or the secondary major surface, wherein the axis of the respective conduit intersects the axis of each other conduits at an intersection point such that the axis of each conduit is at an angle between 90 degrees and 10 degrees relative to the axes of the other conduits, wherein a cross-section of each conduit increases in area from the primary major surface or the secondary major surface to the intersection point, wherein each respective conduit of the conduits further comprises a discrete conduit outlet at the primary major surface and a conduit inlet at the secondary major surface, the conduit inlet aligned with the axis of the respective conduit, wherein each conduit inlet of the conduits partially overlaps another conduit inlet of the conduits forming a common aperture inlet, wherein a shape of the common aperture inlet at the secondary major surface comprises a plurality of overlapping ellipses converging to a minimum width of the common aperture inlet, wherein the overlapping ellipses form a fan shape at a first end of the common aperture inlet, the common aperture inlet further extending along the secondary major surface from the minimum width towards a second end of the common aperture inlet.

16. The sheet of claim 15 wherein the cross-section of each conduit perpendicular to its axis is circular.

17. The sheet of claim 16 wherein the area of each of said cross-sections increases from the primary major surface to the secondary major surface or from the secondary major surface to the primary major surface.

18. The sheet of claim 15 wherein said aperture comprises two or three conduits.

19. In a member having a primary major surface and a secondary major surface, wherein the primary major surface opposes the secondary major surface, a method of forming an array of apertures extending between the primary major surface and the secondary major surface, said method comprising:

forming a first conduit in the member extending from the primary major surface to the secondary major surface and forming a second conduit in the member extending from the primary major surface to the secondary major surface, wherein an axis of the first conduit intersects with an axis of the second conduit, wherein each respective conduit of the first conduit and the second conduit comprises a discrete outlet at the primary major surface and an inlet at the secondary major surface, the inlet aligned with the axis of the respective conduit, wherein each inlet of the first conduit and the second conduit partially overlaps another inlet of the first conduit and the second conduit, wherein each respective conduit of the first conduit and the second conduit further comprises a discrete conduit outlet at the primary major surface and a conduit inlet at the secondary major surface, the conduit inlet aligned with the axis of the respective conduit, wherein each conduit inlet of the first conduit and the second conduit partially overlaps another conduit inlet of the first conduit and the second conduit forming a common aperture inlet, wherein a shape of the common aperture inlet at the secondary major surface comprises a plurality of overlapping ellipses converging to a minimum width of the common aperture inlet, wherein the overlapping ellipses form a fan shape at a first end of the common aperture inlet, the common aperture inlet further extending along the secondary major surface from the minimum width towards a second end of the common aperture inlet.

20. The method of claim 19 further comprising forming a third conduit in the member extending from the primary major surface to the secondary major surface, wherein an axis of the third conduit intersects with the axes of the first and second conduits.

* * * * *